US006673500B1

(12) United States Patent
Patel et al.

(10) Patent No.: US 6,673,500 B1
(45) Date of Patent: Jan. 6, 2004

(54) DOCUMENT SECURITY PROCESSES

(75) Inventors: Raj D. Patel, Oakville (CA); Fatima M. Mayer, Mississauga (CA); Michael A. Hopper, Toronto (CA); Kurt I. Halfyard, Mississauga (CA)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/225,214

(22) Filed: Aug. 20, 2002

(51) Int. Cl.[7] ..... G03G 9/08; G03G 9/09

(52) U.S. Cl. ..... 430/108.2; 430/108.6; 430/120; 430/137.14

(58) Field of Search ..... 430/120, 137.14, 430/10, 108.6, 108.1, 108.2

(56) References Cited

U.S. PATENT DOCUMENTS

| | | | | |
|---|---|---|---|---|
| 3,674,736 A | | 7/1972 | Lerman et al. | 260/41 R |
| 4,796,921 A | | 1/1989 | Neiman | 283/91 |
| 5,208,630 A | | 5/1993 | Goodbrand et al. | 355/201 |
| 5,225,900 A | | 7/1993 | Wright | 358/75 |
| 5,278,020 A | | 1/1994 | Grushkin et al. | 430/137 |
| 5,290,654 A | | 3/1994 | Sacripante et al. | 430/137 |
| 5,308,734 A | | 5/1994 | Sacripante et al. | 430/137 |
| 5,344,192 A | | 9/1994 | Phillips | 283/91 |
| 5,344,738 A | | 9/1994 | Kmiecik-Lawrynowicz et al. | 430/137 |
| 5,370,963 A | | 12/1994 | Patel et al. | 430/137 |
| 5,403,693 A | | 4/1995 | Patel et al. | 430/137 |
| 5,492,370 A | * | 2/1996 | Chatwin et al. | 283/110 |
| 5,554,480 A | | 9/1996 | Patel et al. | 430/137 |
| 5,695,220 A | | 12/1997 | Phillips | 283/91 |
| 5,826,916 A | | 10/1998 | Phillips | 283/91 |
| 5,910,387 A | | 6/1999 | Mychajlowskij et al. | 430/110 |
| 5,916,725 A | | 6/1999 | Patel et al. | 430/137 |
| 5,919,595 A | | 7/1999 | Mychajlowskij et al. | 430/137 |
| 5,925,488 A | | 7/1999 | Patel et al. | 430/137 |
| 5,977,210 A | | 11/1999 | Patel et al. | 523/161 |
| 6,458,165 B1 | * | 10/2002 | Foucher et al. | 430/180.21 |

* cited by examiner

*Primary Examiner*—John Goodrow
(74) *Attorney, Agent, or Firm*—E. O. Palazzo

(57) ABSTRACT

A process comprising applying a toner security mark on a document generated by xerographic means, and which mark possesses white glossy characteristics, and wherein said toner is comprised of a waterborne polymer resin and a colorant, and optionally a second security mark generated by a toner comprised of a waterborne polymer resin and a UV fluorescent component.

40 Claims, No Drawings

DOCUMENT SECURITY PROCESSES

CROSS REFERENCE

There is illustrated in copending U.S. Ser. No. 10/225,408, entitled Document Security Processes, filed concurrently herewith, the disclosure of which is totally incorporated herein by reference, a process comprising generating on a substrate a security mark comprised of a glossy ink containing a colorant; and in U.S. Ser. No. 10/225,411, entitled Document Security Processes, filed concurrently herewith, the disclosure of which is totally incorporated herein by reference, a process comprising applying a toner security mark on a document generated by xerographic means, and which mark possesses white glossy characteristics and wherein the toner is comprised of a polymer and a colorant.

BACKGROUND

The present invention is directed to processes, and more specifically, to a toner process wherein a component of, for example, a white glossy toner mark wherein glossy refers, for example, to a gloss value of about 75 to about 140 gardiner gloss unit (GGU) as measured by a gloss meter at an angle of about 75, and more specifically, from about 80 to about 130 GGU degrees when placed on a substrate, such as paper, is visibly detectable by, for example, the eye when viewed at any angle of, for example, about 10 to about 85 degrees, and more specifically, from about 35 to about 65 degrees. The viewing angle refers, for example, to the angle as measured perpendicular of the document security mark. The present invention is also directed to a process for the generation of white toners for security applications, and which toners contain waterborne polymers or resins; wherein a waterborne resin refers, for example, to a resin that is easily dispersible into submicron particles in warm water, where warm is at a temperature of from about 50° C. to about 80° C.; and which polymer resins can be aggregated and coalesced to provide materials for xerographic applications. Optionally, the substrate for the security mark can contain a second toner mark containing a waterborne resin, which mark is not visible to the eye, and is detectable when, for example, radiated with UV light becomes visible to the eye. Documents containing such marks when reproduced xerographically result in the absence of the white glossy marks or the marks appear as a dull gray mark indicating a fake.

In embodiments, the process of the present invention comprises the xerographic generation of documents, such as tickets, like tickets to sports activities, coupons, classified papers, currency, and the like by the formation of a security mark, water mark, indicia thereon, and which mark when dried possesses a white shiny or glossy surface where shiny or glossy refers, for example, to having a highly reflective surface wherein most, over about 50 percent, of the incident light is reflected from the surface, and wherein the mark is more glossy compared to the remainder of the document and wherein duplication, or counterfeiting thereof by, for example, xerography, ink jet printing, and the like will result in the absence of the security mark or the security mark may appear as a dull black/grey mark thereby indicating that the document is not authentic and is a forgery or fake. Accordingly, the use of costly sophisticated instruments to authenticate the mark can be avoided, since the security mark generated with the processes disclosed herein can be detected visually. Moreover, in embodiments a plurality of security marks may be included in the document, wherein plurality refers to at least two, and can be from about two to about ten, and more specifically, from about 2 to about 6, and yet more specifically, about 2 to about 4.

REFERENCES

Illustrated in U.S. Pat. No. 5,208,630, the disclosure of which is totally incorporated herein by reference, are processes for the authentication of documents, such as tickets, credit cards, and the like, by generating these documents with a toner containing an infrared light absorbing component, which compositions are detectable when exposed to radiation outside the visible wavelength range, and more specifically, a wavelength of from between about 650 to about 950 nanometers.

Illustrated in U.S. Pat. No. 5,225,900, the disclosure of which is totally incorporated herein by reference, is a process for controlling a reproduction system comprising scanning an image to detect at least one taggant in at least one marking material forming the image; issuing instructions to a reproduction system, and which instructions cause the reproduction system to proceed in a certain manner.

Further of interest is U.S. Pat. No. 5,554,480, which discloses, for example, a toner containing a UV pigment, and U.S. Pat. Nos. 5,344,192; 5,826,916; 5,695,220 and 4,796,921, the disclosures of which are totally incorporated herein by reference.

SUMMARY

It is a feature of the present invention to provide processes for the generation of images on a number of documents.

Also, it is another feature of the present invention to provide permanent security marks on documents.

It is yet another feature of the present invention to provide a visible mark on security documents, such as tickets, coupons, identification badges, passes, negotiable securities, and the like, and which mark or marks are formed by a composition of a white pigment and a waterborne polymer resin, which composition when fused forms a white glossy mark which is substantially visible to the eye at substantially any angle, irrespective of the light source location and optionally further containing a second security mark which is not visible to the naked eye, which optional mark is comprised, for example, of toners containing a component that fluoresces under an ultraviolet light and a waterborne resin, wherein the fluorescent component can be either a pigment, a dye, or mixtures thereof that is excited in the ultraviolet region of the light spectrum of a wavelength of from about 200 to about 400 nanometers and also fluoresces at about 400 to about 700 nanometers in the visible spectral region.

Additionally, it is another feature of the present invention to provide processes that prevent the duplication of documents, including security documents, like tickets, coupons or credit cards.

Another feature of the present invention is to provide processes for determining the authenticity of documents, such as tickets, coupons, credit cards, security badges, and the like.

Further, in another feature of the present invention there are provided security marks comprised of white toners containing titanium dioxide ($TiO_2$) and a waterborne polymer, or a resin such as sulfonated polyester.

Moreover, in yet another feature of the present invention there are provided covert document authentication processes wherein selected areas, or words of documents can be readily and rapidly distinguished from the remainder of the document, and also a second mark detectable by, for example, illuminating this mark with a UV device, thereby enabling security or special coding of the document wherein the coding can be in the form of a letter or numbers which are not visible to the eye, and detectable by a UV detector. The colorants selected for the second mark in embodiments are those that fluoresce under ultraviolet light, that is, for example, a wavelength of from about 200 nanometers to about 400 nanometers.

It is still another feature of the present invention to provide toners generated by aggregation/coalescence processes of a colorant, such as a white pigment and a waterborne resin where waterborne refers, for example, to a resin which is dispersible or can be dissipated, that is the resins form a spontaneous emulsion in warm deionized water to provide an emulsion of submicron resin particles, and which toners can provide a means for placing coded information on a document, and which compositions can be selected for trilevel color imaging processes.

Aspects of the present invention relate to a process comprising applying a toner security mark on a document generated by xerographic means, and which mark possesses white glossy characteristics, and wherein the toner is comprised of a waterborne polymer and a colorant; a process wherein the toner is generated by (i) preparing a waterborne resin emulsion comprised of resin particles dispersed in water;

(ii) mixing the resulting emulsion with a white colorant dispersion suspended in a nonionic surfactant and water;

(iii) heating the resulting emulsion colorant mixture to a temperature of about 5° C. to about 10° C. above the resin Tg, and adding a coagulant to the above mixture (iii) to initiate flocculation of resin and colorant particles;

(iv) maintaining the above temperature for an additional about 2 to about 10 hours to provide toner size particles of about 3 to about 7 microns in diameter, and optionally with narrow particle size distribution of about 1.14 to about 1.20;

(v) washing the resulting toner slurry with water, and isolating the toner obtained; a process wherein the mark is present on a coupon, or currency; a process wherein the colorant is a white pigment present in an amount of from about 10 to about 40 percent, and the polymer is present in an amount of from about 90 to about 60 percent; a process wherein the colorant is a white pigment present in an amount of from about 20 to about 30 percent, and the polymer is present in an amount of from about 80 to about 70 percent, and wherein the total of the two components is about 100 percent; a process wherein the mark is visible when viewed at angles of from about 15 to about 85 degrees from the perpendicular; a process wherein the viewing angle is from about 35 to about 65 degrees; a process wherein the waterborne polymeric resin possesses a molecular weight, $M_w$, of about 6,000 to about 150,000; a process further including a second security mark containing a waterborne polymer and a UV fluorescent colorant; a process further including a second security mark prepared by (i) preparing a waterborne resin emulsion comprised of resin particles of, for example, a size diameter of from about 30 to about 100 nanometers dispersed in water;

(ii) mixing the emulsion with a UV fluorescent component dispersion comprised of, for example, submicron particles suspended in a nonionic surfactant and water;

(iii) heating the emulsion colorant mixture to a temperature of about 5° C. to about 10° C. above the resin Tg;

(iv) adding a coagulant to the above mixture (iii) to initiate flocculation of resin and colorant particles, and isolating the toner product; a process wherein the colorant is a white pigment of titanium dioxide, aluminum oxide, zirconium oxide or zinc oxide; a process wherein the white pigment is titanium dioxide present in an amount of about 20 to about 30 percent by weight of toner, and there is present about 80 to about 70 percent of polymer resin; a process wherein there is further added a second security mark comprised of a UV excited fluorescent pigment present in an amount of about 3 to about 8 weight percent by weight of toner, and the waterborne polymer resin is selected in an amount of about 97 to about 92 weight percent by weight of toner; a process wherein the UV excited fluorescent pigment is present in an amount of about 4 to about 7 weight percent by weight of toner; a process wherein the UV fluorescent pigment is initially invisible, and subsequently rendered visible when subjected to UV light; a process wherein the UV fluorescent pigment is selected from the group consisting of 4,4'-bis(styryl)biphenyl, 2-(4-phenylstilben4-yl)-6-butylbenzoxazole, beta-methylumbelliferone, 4,-methyl-7-dimethylaminocoumarin, 4-methyl-7-aminocoumarin, N-methyl-4-methoxy-1,8-naphthalimide, 9,10-bis(phenethynyl) anthracene, and 5,12-bis(phenethynyl) naphthacene; a process comprising applying a security mark toner on a document, and which mark possesses white glossy characteristics, and wherein the mark is visible and contains a pigment embedded in a waterborne polymer resin, and a second toner mark which contains a colorant that fluoresces under UV light; a process comprising providing a security mark or marks on a document generated xerographically, and which mark is comprised of a glossy toner containing a waterborne polymer resin and a pigment; a process wherein the waterborne polymer resin is as sodio-sulfonated polyester, or a styrene acrylate carboxylic acid; a process wherein the waterborne polymer is a poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylene-diethylene-sodio 5-sulfoisophthalate)-copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate); poly(butylacrylate acrylic acid), poly(butylacrylate methacrylic acid), poly(butylacrylate itaconic acid), poly(butylacrylate beta carboxy ethyl acrylate), poly (butylacrylate methylmethacrylate acrylic acid), poly (butylacrylate methylmethacrylate methacrylic acid), poly(butylacrylate methylmethacrylate itaconic acid), poly(butylacrylate methylmethacrylate beta carboxy ethyl acrylate), poly(methylmethacrylate acrylic acid), poly(methylmethacrylate methacrylic acid), poly (methylmethacrylate itaconic acid), poly (methylmethacrylate beta carboxy ethyl acrylate), poly (butylacrylate butylmethacrylate acrylic acid), poly (butylacrylate butylmethacrylate methacrylic acid), poly(butylacrylate butylmethacrylate itaconic acid), poly(butylacrylate butylmethacrylate beta carboxy ethyl acrylate), poly(styrene butylacrylate acrylic acid), poly(styrene butylacylate methacrylic acid), poly (styrene butylacrylate itaconic acid), or poly(styrene butylacrylate beta carboxy ethyl acrylate); a process wherein the waterborne polymer is present in an amount of from about 65 to about 85 weight percent; a process wherein the glossy value is from about 65 to about 99 GGU as measured at an angle of 75 degrees; a process wherein the glossy value is from about 75 to about 140 GGU as measured at an angle of 75 degrees; a process wherein the coagulant is selected from the group comprising sodium chloride, magnesium chloride, zinc chloride, aluminum chloride, calcium chloride, zinc sulfate, magnesium sulfate, aluminum sulfate, zinc acetate amines of triethylamine, tripropylamine, 2-methyl-1,5-pentanediamine, 1,4-diaminobutane, 1,8-diaminooctane, 1,5-diaminopentane, 1,6-diaminohexane, 1,7-diaminoheptane, 1,3-diaminopropane, 1,2-diaminopropane, and 1,3-diamino-2-hydroxypropane, and which coagulant is, for example, selected in an amount of about 1 to about 10 weight percent; a process wherein the coagulant is zinc acetate; a process wherein the polymer is selected from the group consisting of known polymers of, for example, poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylene-diethylene-sodio 5-sulfoisophthalate)-copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate), and wherein the coagulant salt is sodium chloride, potassium chloride, sodium bromide, or potassium bromide; poly(butylacrylate acrylic acid), poly (butylacrylate methacrylic acid), poly(butylacrylate itaconic acid), poly(butylacrylate beta carboxy ethyl acrylate), poly(butylacrylate methylmethacrylate acrylic acid), poly(butylacrylate methylmethacrylate methacrylic acid), poly(butylacrylate methylmethacrylate itaconic acid), poly(butylacrylate methylmethacrylate beta carboxy ethyl acrylate), poly (methylmethacrylate acrylic acid), poly (methylmethacrylate methacrylic acid), poly (methylmethacrylate itaconic acid), poly (methylmethacrylate beta carboxy ethyl acrylate), poly (butylacrylate butylmethacrylate acrylic acid), poly (butylacrylate butylmethacrylate methacrylic acid), poly(butylacrylate butylmethacrylate itaconic acid), poly(butylacrylate butylmethacrylate beta carboxy ethyl acrylate), poly(styrene butylacrylate acrylic acid), poly(styrene butylacylate methacrylic acid), poly (styrene butylacrylate itaconic acid), and poly(styrene butylacrylate beta carboxy ethyl acrylate); a process wherein a barcode is contained on the surface of the security mark; a process wherein a barcode is situated below the UV fluorescent security mark; a process wherein the security mark is located at various positions on the document; a process wherein a second security mark is contained on the document, and which security mark contains a UV sensitive pigment; a process for avoiding the reproduction of a document by providing a security mark on the document, and which mark is comprised of a glossy toner containing a pigment, and optionally a second mark containing a UV sensitive pigment; a process wherein the document is a ticket, a coupon, an identification badge, or a negotiable security; a process wherein the mark is viewed at an angle of from about 15 to about 85 degrees of the light source; a process comprising depositing a security mark on a document, and which mark possesses white toner glossy characteristics, and wherein the toner is comprised of a waterborne polymer and a colorant, and a second security mark; a process wherein subsequent to (iii) the coagulant is added over a time period of about 0.5 to about 3 hours to initiate flocculation of resin and colorant particles, and maintaining the temperature for an additional about 2 to about 10 hours to provide toner size particles; a process wherein subsequent to (vii) the temperature of from about 5° C. to about 10° C. above the resin Tg is maintained for about 2 to about 10 hours to provide toner particles of about 3 to about 10 microns in volume average diameter, and isolating the toner product; a process wherein the waterborne polymer is poly(1,2-propylene-sodio 5-sulfoisophthalate), or poly(methylmethacrylate acrylic acid); an emulsion aggregation toner process for the preparation of a security mark, which mark is a white glossy mark comprised of a suitable pigment like a titanium dioxide pigment and a waterborne resin, and wherein the white glossy mark is apparent or clearly visible to the human eye at an angle of, for example, from about 10 to about 85 degrees irrespective of the light location when the light source is located across the viewing angle or behind the viewing or on top of the viewing angle, and which white glossy mark is, more specifically, viewed at the angles of about 35 to about 65 degrees, and preferably from about 40 to about 60 degrees of the light source; the viewing angle refers, for example, to the angle measured perpendicular of the document security mark; a process wherein the amount of the white pigment, such as titanium dioxide $TiO_2$, used to generate the security mark either by a toner in a xerographic process, or with an ink by lithographic means is, for example, in excess of about 40 percent by weight, for example from about 41 to about 65 of the formulation results in a reduction of the viewing angle by about 50 percent; a process wherein the security mark is clearly visible at angles from about 0 to about 180 degrees, and more specifically, angles from about 45 to about 75 degrees, and yet more specifically, from about 40 to about 65 degrees when viewed by the eye irrespective of the location of the light source; a process for the formation of a security mark utilizing a xerographic toner containing a waterborne polymer having a molecular weight ($M_w$) of about 8,000 to about 50,000, and more specifically, about 10,000 to about 35,000, and a titanium dioxide pigment present in an amount of about 10 to about 40 percent, and more specifically, about 20 to about 30 weight percent by weight of toner; and a process for providing a secondary security mark on a document, which second mark fluoresces when illuminated with a UV light source; the secondary mark, which can be placed on a document, such as a coupon, in addition to the visible primary white glossy mark provides a security mark for automatic checkout, wherein the coupon is authenticated by a barcode and the UV security mark, and wherein reproduced or duplicated copies can result in the absence of both marks, indicating a fake or a counterfeit document.

The security mark can appear as a white glossy reflecting surface, and which mark can be located in various areas of the document and be of various sizes, and wherein in embodiments a barcode can be placed thereover, and optionally wherein the mark can be placed in any format on any part of the document, and is visible to the naked eye when viewed at a number of different angles. The mark can be generated with a number of various suitable components, and more specifically, by a toner comprised of a waterborne polymer, such as sulfonated polyester, sulfonated styrene acrylate, or styrene acrylate carboxylic acids, which are known toner polymers selected for xerography and a colorant, preferably a white colorant, or pigment of, for example, titanium dioxide, aluminum oxide, zinc oxide, zirconium oxide, and which security mark cannot be readily effectively reproduced. The toner selected can be prepared by a number of processes, such as the emulsion aggregation processes illustrated herein. Thus, in embodiments the toner selected can be formed by aggregating a colorant dispersion comprised of about 30 to about 65 percent colorant, about 70 to about 35 percent water, and from about 1 to about 5 pph of a nonionic surfactant, and wherein the colorant is, for example, a pigment of titanium dioxide particles, usually in the size range diameter of about 0.05 to about 0.70 micron suspended in aqueous phase in the presence of a dispersant. The aforementioned toners can then be applied xerographically to the document to be protected.

The security mark can be applied prior to generating the final document, during the preparation of the document, or subsequent to the preparation of the document. Optionally, in addition to the security mark illustrated herein, the document, such as a check, a coupon or other security document, may contain a second mark which when radiated by a light source, such as a UV light source, is rendered visible. The aforementioned second mark can be generated with, for example, a toner that contains an emitting component or a component that fluoresces in the about 400 to about 700 nanometers visible spectral region, such component being, for example, 4,4'-bis(styryl)biphenyl, 2-(4-phenylstilben-4-yl)-6-butylbenzoxazole, beta-methyl umbelliferone, 4,-methyl-7-dimethylaminocoumarin, 4-methyl-7-aminocoumarin, N-methyl-4-methoxy-1,8-naphthalimide, 9,10-bis(phenethynyl) anthracene, 5,12-bis (phenethynyl)naphthacene, or DAYGLO INVISIBLE BLUE™ A-594-5, and the like. The toner usually contains the light emitter dissolved or finely dispersed in a polymer resin thereof. An example of a toner that may be selected for generating a security mark is comprised of a waterborne polymer resin such as sulfonated polyester selected in an amount of, for example, about 85 to about 65 percent by weight of toner, and more specifically, from about 80 to about 70 percent by weight of toner, and a pigment like titanium dioxide present, for example, in an amount about 15 to about 35 weight percent by weight of toner, and more specifically, about 20 to about 30 percent by weight of toner. A second toner for the generation of an additional security mark can comprise a waterborne polymer resin selected in an amount of about 90 to about 98 percent by weight of toner and an emitter component of about 10 to about 2 percent by weight of toner, and wherein the toner for the first and second security marks may contain flow aids and charge control additives.

The toners selected for the generation of the security mark can be obtained from various sources, and more specifically, these toners can be generated by the emulsion/aggregation/coalescing processes illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also U.S. Pat. Nos. 5,348,832; 5,405,728; 5,366,841; 5,496,676; 5,527,658; 5,585,215; 5,650,255; 5,650,256 and 5,501,935; 5,723,253; 5,744,520; 5,763,133; 5,766,818; 5,747,215; 5,827,633; 5,853,944; 5,804,349; 5,840,462; 5,869,215; 5,869,215; 5,863,698; 5,902,710; 5,910,387; 5,916,725; 5,919,595; 5,925,488 and 5,977,210.

Examples of waterborne resins, that is for example, water compatible resins, include for example, poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylene-diethylene-sodio 5-sulfoisophthalate)-copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate), and wherein the salt is sodium chloride, potassium chloride, sodium bromide, or potassium bromide; poly(butylacrylate acrylic acid), poly (butylacrylate methacrylic acid), poly(butylacrylate itaconic acid), poly(butylacrylate beta carboxy ethyl acrylate), poly (butylacrylate methylmethacrylate acrylic acid), poly (butylacrylate methylmethacrylate methacrylic acid), poly (butylacrylate methylmethacrylate itaconic acid), poly (butylacrylate methylmethacrylate beta carboxy ethyl acrylate), poly(methylmethacrylate acrylic acid), poly (methylmethacrylate methacrylic acid), poly (methylmethacrylate itaconic acid), poly (methylmethacrylate beta carboxy ethyl acrylate), poly (butylacrylate butylmethacrylate acrylic acid), poly (butylacrylate butylmethacrylate methacrylic acid), poly (butylacrylate butylmethacrylate itaconic acid), poly (butylacrylate butylmethacrylate beta carboxy ethyl acrylate), poly(styrene butylacrylate acrylic acid), poly (styrene butylacylate methacrylic acid), poly(styrene butylacrylate itaconic acid), and poly(styrene butylacrylate beta carboxy ethyl acrylate).

The sulfonated polyesters may in embodiments be represented by

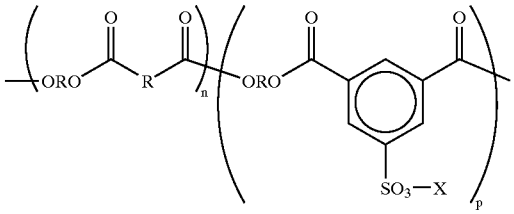

wherein R is, for example, an alkylene of from about 2 to about 25 carbon atoms, such as ethylene, propylene, butylene, or oxyalkylene diethyleneoxide, and the like; R' is an arylene of from about 6 to about 36 carbon atoms such as a benzylene, bisphenylene, bis(alkyloxy) bisphenolene, and the like; and n represents the number of segments and can be, for example, a number of from about 10 to about 1,000, and more specifically, from about 100 to about 700. The alkali sulfopolyester possesses, for example, a number average molecular weight ($M_n$) of from about 1,500 to about 50,000 grams per mole, and a weight average molecular weight ($M_w$) of from about 6,000 grams per mole to about 150,000 grams per mole as measured by gel permeation chromatography and using polystyrene as standards.

Various organic diacids or esters of diacids can be selected to form the products of the present invention, such as those selected from the group consisting of fumaric acid, malonic acid, itaconic acid, 2-methylitaconic acid, maleic acid, maleic anhydride, adipic acid, succinic acid, suberic acid, 2-ethyl succinic acid, glutaric acid, dodecylsuccinic acid, 2-methyladipic acid, pimelic acid, azelaic acid, sebacic acid, terephthalic acid, isophthalic acid, phthalic acid, 1,2-cyclohexanedioic acid, 1,3-cyclohexanedioic acid, 1,4-cyclohexanedioic acid, dialkyl esters wherein alkyl contains from about 2 to about 22 carbon atoms, and are esters of malonate, succinate, fumarate, itaconate, terephthalate, isophthalate, phthalate, cyclohexanedioate, and mixtures thereof, and which diacids are optionally selected in an amount of from 35 mole percent to about 0.45 mole percent based on about 100 mole percent of resin product.

Examples of sulfonated organic diacids or esters of diacids include those selected from the group comprised of sodio 5-sulfoisophthalic acid, potasio 5-sulfoisophthalic acid, sodio 2-sulfoterephthalic acid, potasio 2-sulfoterephthalic acid, dimethyl 5-sulfoisophthalate sodium salt, dimethyl 5-sulfoisophthalate potassium salt, and mixtures thereof, and which diacids are optionally selected in an amount of from 1 mole percent to about 10 mole percent, based on about 100 mole percent of resin product.

The resins can be prepared by a number of processes, such as for example, by the melt condensation reaction of an organic diol selected in an amount of, for example, from about 60 to about 80 part percent and an organic diacid selected, for example, in an amount of from about 40 to about 20 part percent, and about 1 to about 10 parts per hundred of a sodio sulfonated organic diacid such as sodio 5-sulfoisophthalic acid. More specifically, the sulfonated polyester-amine resin can be obtained by a melt condensation process comprised of charging a reactor equipped with a mechanical stirrer and distillation apparatus with from about 95 to about 105 mole percent of a glycol, such as propylene glycol, diethylene glycol, dipropylene glycol or mixtures thereof, with from about 35 to about 40 mole percent of an organic diacid, such as terephthalic acid, or sebaic acid of from about 5 to about 15 mole percent of a sulfonated organic diacid, such as sodio 5-sulfoisophthalic acid or dimethyl 5-sulfo-isophthalate sodium salt, and a polycondensation catalyst, such as stannoic acid or tetrabutyl titanate, in an amount of from about 0.005 to about 0.5 mole percent. The contents are then heated to a temperature of from about 150° C. to about 190° C., and wherein water or alcohol is distilled off during a period of from about 3 to about 6 hours. Thereafter, the temperature is increased to from about 205° C. to about 220° C., and the pressure is reduced from atmospheric pressure to about 1 mm-Hg over a duration of, for example, from about 3 to about 6 hours, and during which water or alcohol, and the excess glycol is distilled off. The pressure of the reaction is then reverted back to atmospheric pressure and the contents discharged through a bottom drain of the reactor to provide a sodio sulfonated polyester resin, such as a random copoly(1,2-propylene-terephthalate)-copoly(1,2-propylene-sodio 5-sulfo-isophthalate)-copoly(1,2-propylene-asaparatate), with a glass transition temperature of from about 50° C. to about 65° C., a number average molecular weight of from about 2,000 to about 50,000 grams per mole, and a weight average molecular weight of from about 5,000 to about 100,000 grams per mole, and a polydispersity of, for example, from about 2 to about 30.

Examples of organic diols utilized in preparing the aforementioned sulfonated polyesters of the present invention include diols or glycols, such as alkylene glycols, with a carbon chain length of, for example, from about 1 to about 25 carbon atoms, and more specifically, ethylene glycol, 1,2-propylene glycol, 1,3-propylene glycol, 1,2-butylene glycol, 1,3-butylene glycol, 1,4-butylene glycol, 1,2-pentylene glycol, 1,3-pentylene glycol, 1,4-pentylene glycol, 1,5-pentylene glycol, hexylene glycol, heptalyne glycol, diethylene glycol, dipropylene glycol, cyclohexane diol, 2,2-dimethyl propane diol, neopentylene glycol, octylene glycol, cyclohexane dimethanol, mixtures thereof, and the like; and which glycols are employed in various effective amounts of, for example, from about 45 to about 55 mole percent of the resin product.

The polymer particles selected, which generally can be in embodiments sulfonated polyesters or styrene acrylate carboxylic acids, are present in various effective amounts, such as from about 70 weight percent to about 99 weight, and more specifically, from about 75 to about 90 percent of the toner, and which toner can be of a small average particle size, such as from about 0.01 micron to about 9 microns in average volume diameter as measured by the Brookhaven nanosize particle analyzer. Other effective amounts of resin can be selected.

Examples of nonionic surfactants that can be selected for the pigment dispersion include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhodia as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. A suitable concentration of the nonionic surfactant is, for example, from about 0.01 to about 10 percent by weight, and preferably from about 0.1 to about 5 percent by weight of monomers used to prepare the toner polymer resin.

The anionic surfactants that can be selected for the pigment dispersion can be selected from, for example, sodium dodecylsulfate (SDS), sodium dodecylbenzene sulfonate, sodium dodecylnaphthalenesulfate, dialkyl benzenealkyl, sulfates and sulfonates, abitic acid, available from Aldrich, NEOGEN RK™, NEOGEN SC™ from Kao, and the like. An effective concentration of the anionic surfactant generally employed is, for example, from about 0.01 to about 10 percent by weight, and preferably from about 0.1 to about 5 percent by weight of monomers used to prepare the toner polymer resin.

Coagulants that can be included in the toner in amounts of, for example, from about 1 to about 10 weight percent include monovalent, divalent or multivalent salts, zinc acetate, quaternary amines and the like. The coagulant is in embodiments present in an aqueous medium in an amount of from, for example, about 0.05 to about 20 percent by weight, and more specifically, in an amount of from about 1 to about 15 percent by weight. The coagulant is usually added slowly at a rate of about 1 to about 3 milliliters per minute into the reactor mixture while being continuously stirred at a speed of about 170 to about 500 rpm, while being heated up to a temperature above the resin Tg. More specifically, the temperature of the heating is from, for example, about 2° C. to about 10° C. above the Tg of the resin to facilitate continuous coalescence of resin and pigment particles resulting in toner size particles with narrow GSD after 10 hours.

The solids content of the waterborne resin latex dispersion is not particularly limited. The solids content may be, for example, from about 10 to about 90 percent. With regard to the pigment, such as titanium dioxide, in some instances they are available in the wet cake or concentrated form containing water, and can be easily dispersed utilizing a homogenizer or simply by stirring or ball milling or attrition, or media milling. In other instances, pigments are available only in a dry form, whereby dispersion in water is effected by microfluidizing using, for example, a M-110 microfluidizer or an ultimizer and passing the pigment dispersion from about 1 to about 10 times through a chamber, by sonication, such as using a Branson 700 sonicator, with a homogenizer, ball milling, attrition, or media milling with the optional addition of dispersing agents such as the aforementioned ionic or nonionic surfactants.

Various known pigments that can be selected include titanium dioxide, zinc oxide, aluminum oxide, or zirconium oxide, other similar metal oxides, and the like. In embodiments, the pigment particles are present in the toner composition in an amount of from about 10 percent by weight to about 40 percent by weight, and more specifically, in the range of about 20 to about 30 percent calculated on the weight of the dry toner, and more specifically, from about 20 to about 30 weight percent by weight of toner. The white pigment can be selected from the group consisting of titanium dioxide, aluminum oxide, zirconium oxide and zinc oxide.

The UV fluorescent component can be, for example, selected from the group consisting of 4,4'-bis(styryl) biphenyl, 2-(4-phenylstilben-4-yl)-6-butylbenzoxazole, beta-methylumbelliferone, 4,-methyl-7-dimethylamino coumarin, 4-methyl-7-aminocoumarin, N-methyl-4-methoxy-1,8-naphthalimide, 9,10-bis(phenethynyl) anthracene, 5,12-bis(phenethynyl) naphthacene, or DAYGLO INVISIBLE BLUE™ A-594-5, and with DAYGLO INVISIBLE BLUE™ being preferred, and the like.

For the optional additional security marks, the toner compositions can be prepared by using a fluorescing pigment, such as DAYGLO blue or 4,4'-bis(styryl)biphenyl, wherein the pigment, submicron in size, is suspended in water in the presence of an ionic surfactant which is then aggregated and coalesced with waterborne resin latex particles.

Moreover, in embodiments there are illustrated security marks generated with a toner containing a pigment, such as titanium dioxide, and wherein the toner can be prepared by aggregation/coalescence processes as illustrated herein, and wherein the toner is provided on a document, such as paper, utilizing xerographic processes. The resulting aforementioned mark document is then fused on, for example, a matte substrate, such as Xerox 4024 paper, or a glossy substrate, and wherein the mark possesses white shiny characteristics, and which mark is visible to the eye. When the document containing the security mark is copied, there results a copy without the white shiny or glossy secured mark. Therefore, the absence of the security mark on the copy or copies indicates that it is not authentic, a forgery, a counterfeit, or other nonauthorized copy.

Any suitable printing apparatus art may be employed to place the marks on the paper. More specifically, the printing apparatus can be an electrostatographic printing machine that incorporates six developer housings for the purposes of full color where each developer housing contains toner particles of a different color, that is black, yellow, magenta, cyan, a white glossy toner and a white UV fluorescent toner. Also, 2 or more printing engines requiring 6 developer housings can be selected to provide a full pictorial in addition to the security marks.

With regard to two sided coupons, wherein the first side usually contains a full color image of the product being advertised/offered, or optionally a single color which is printed on a paper substrate followed by printing on the reverse of the paper the conditions of coupon redemption, a barcode all in black ink, together with two white security ink marks. The security ink marks can be deposited in various combinations including placing a barcode on top of the white glossy mark with the UV fluorescing mark being placed next to the white glossy mark containing the barcode, or placing the barcode on top of the UV emitter mark with the white glossy mark placed next to the UV fluorescing mark containing the barcode. The security marks can optionally be placed in independent location of each other and in any area on the document, such as paper. Regarding a single sided coupon there can be selected a printing machine with three ink stations, one containing a black ink for writing text messages and placing the barcode, a second developer housing containing a white glossy ink, and a third containing a UV emitter. For color, a fourth ink station can be utilized. The barcode is usually placed on a white background for maximum contrast in order for the scanner to read the barcode. The security marks are hence placed next to the barcode or below the barcode. In all cases, the coupons are usually full of color on one side while the reverse side is about 95 to about 99 percent white where the text information, such as addresses, or P.O. box, including the barcode, are all printed in black.

The following Examples are being submitted to further define various species of the present invention. These Examples are intended to be illustrative only and are not intended to limit the scope of the present invention.

EXAMPLE I

Preparation of Sulfonated Polyester

Moderately sulfonated polyester prepared by polycondensation reactions was selected with a sufficient enough loading of sulfonate groups to afford ready dissipation of the polymer in warm water wherein warm was, for example, from about 5° C. to about 10° C. more than the Tg of the polyester resin to submicron particles.

Preparation of Linear Moderately Sulfonated Polyester

A linear sulfonated random copolyester resin comprised of, on a mol percent, approximately 0.465 of terephthalate, 0.035 of sodium sulfoisophthalate, 0.475 of 1,2-propanediol, and 0.025 of diethylene glycol was prepared as follows. In a one liter Parr reactor equipped with a bottom drain valve, double turbine agitator, and distillation receiver with a cold water condenser were charged 388 grams of dimethylterephthalate, 44.55 grams of sodium dimethylsulfoisophthalate, 310.94 grams of 1,2-propanediol (1 mole excess of glycol), 22.36 grams of diethylene glycol (1 mole excess of glycol), and 0.8 gram of butyltin hydroxide oxide as the catalyst. The reactor was then heated to 165° C. with stirring for 3 hours whereby 115 grams of distillate were collected in the distillation receiver, and which distillate was comprised of about 98 percent by volume of methanol and 2 percent by volume of 1,2-propanediol as measured by the ABBE refractometer available from American Optical Corporation. The mixture was then heated to 190° C. over a one hour period, after which the pressure was slowly reduced from atmospheric pressure to about 260 Torr over a one hour period, and then reduced to 5 Torr over a two hour period with the collection of approximately 122 grams of distillate in the distillation receiver, and which distillate was comprised of approximately 97 percent by volume of 1,2-propanediol and 3 percent by volume of methanol as measured by the ABBE refractometer. The pressure was then further reduced to about 1 Torr over a 30 minute period whereby an additional 16 grams of 1,2-propanediol were collected. The reactor was then purged with nitrogen to atmospheric pressure, and the polymer discharged through the bottom drain onto a container cooled with dry ice to yield 460 grams of the 3.5 mol percent sulfonated polyester resin, copoly(1,2-propylene-diethylene)terephthalate-copoly (sodium sulfoisophthalate dicarboxylate). The sulfonated polyester resin glass transition temperature was measured to be 59.5° C. (onset) utilizing the 910 Differential Scanning Calorimeter, available from E.I. DuPont, operating at a heating rate of 10° C. per minute. The number average molecular weight was measured to be 3,250 grams per mole, and the weight average molecular weight was measured to be 5,290 grams per mole using tetrahydrofuran as the solvent. A particle size of 57 nanometers (volume weighted) was measured using a Nicomp particle sizer.

Preparation of Latex Stock Solutions

Submicron dispersions of the appropriate sulfonated polyester resin, for example those prepared above, in distilled deionized water were prepared by first heating the water to about 10° C. to about 15° C. above the glass transition of the sulfonated polyester polymer and then slowly adding the polymer with stirring until it had fully dispersed. The resulting latexes had a characteristic blue tinge and a resin particle size diameter of from about 5 to about 100 nanometers. Generally, about 24 grams of the sulfonated polyester were dissipated in 2,000 grams of water.

EXAMPLE II

Preparation of 20 Percent White Toner

About 2,000 grams of the above prepared 12 percent latex emulsion and 79.3 grams of an aqueous titanium dioxide ($TiO_2$) dispersion with a solids loading of 75.7 percent and 24.3 percent deionized water were charged into a 4 liter glass reaction vessel equipped with a P4 stirring blade and fan. The mixture was stirred at 225 rpm and heated to 56° C. To this mixture was added 1 liter of a zinc acetate solution containing 30 grams of zinc acetate dihydrate and 970 grams of water at a rate of 5.6 milliliters per minute. Heating for a total of 510 minutes resulted in aggregates of a size diameter of 3.9 micrometers and a Geometric Standard Deviation ("GSD") of 1.17. The temperature of the above mixture was then increased to 57° C. after 580 minutes of heating and further increased to 58° C. at 672 minutes of heating. At 770 minutes of heating, 33.3 grams of a zinc acetate solution containing 1 gram of zinc acetate dihydrate and 32.3 grams of water was slowly added at a rate of 5.6 milliliters per minute. At 820 minutes of heating, 133.3 grams of a zinc acetate solution containing 4 grams of zinc acetate dihydrate and 129.2 grams of water were slowly added at a rate of 5.6 milliliters per minute. At 965 minutes of heating, 166.7 grams of a zinc acetate solution containing 5 grams of a zinc acetate dihydrate and 161.7 grams of water were slowly added at a rate of 5.6 milliliters per minute. The particle diameter size of the aggregates resulting was found to be 5.56 micrometers and the GSD was 1.17 at 1,180 minutes of heating. The temperature of the mixture was then increased to 59° C. at 1,235 minutes of heating. At 1,260 minutes of total heating, the resulting particles were spherical with a size diameter of 5.8 micrometers and a GSD of 1.17. The reactor was then cooled down to room temperature, about 22° C. to about 25° C., and the resulting particles were washed 3 times with deionized water. The particles were then dried on a freeze dryer at a temperature of −80° C. for a period of 3 days. The toner particles obtained were comprised of 80 percent (by weight throughout unless otherwise indicated) of the sulfonated polyester resin and 20 percent of the above titanium dioxide pigment.

EXAMPLE III

Preparation of 28 Percent White Toner (28 Percent $TiO_2$ Pigment)

About 2,000 grams of the above prepared Example I, 12 percent latex emulsion and 123.3 grams of an aqueous titanium dioxide ($TiO_2$) dispersion with a solids loading of 75.7 percent and 24.3 percent deionized water were charged into a 4 liter glass reaction vessel equipped with a P4 stirring blade and fan. The mixture was stirred at 225 rpm and heated to 56° C. To this mixture were added 1.6 liters of a zinc acetate solution containing 48 grams of zinc acetate dihydrate and 1,552 grams of water at a rate of 5.6 milliliters per minute. The temperature of the mixture was increased to 57° C. (degrees Centigrade throughout) at 580 minutes of heating and further increased to 58° C. at 672 minutes of heating. The temperature of the mixture was then increased to 59° C. at 1,235 minutes of heating. At 1,360 minutes of total heating, the resulting particles were spherical with a size diameter of 5.8 micrometers and a GSD of 1.18. The reactor was then cooled down to room temperature, about 22° C. to about 25° C., and the resulting particles were washed 3 times with deionized water. The particles were then dried on a freeze dryer at a temperature of −80° C. for a period of 3 days. The toner particles obtained were comprised of 72 percent of the sulfonated polyester resin and 28 percent of the titanium dioxide pigment.

EXAMPLE IV

Preparation of a UV Fluorescent Toner (A UV Fluorescent)

About 2,000 grams of the above prepared 12 percent latex emulsion and 140.3 grams of a UV fluorescent dispersion containing 9 grams of DAYGLO INVISIBLE BLUE™ pigment, 90 grams of water and 1 gram of anionic surfactant (NEOGEN RK™) were charged into a 4 liter glass reaction vessel equipped with a P4 stirring blade and fan. The mixture was stirred at 225 rpm and heated to 56° C. To this mixture were added, at a rate of 5.6 milliliters per minute, 400 milliliters of zinc acetate solution containing 12 grams of zinc acetate dihydrate and 388 grams of water. The temperature of the mixture was then increased to 57° C. at 580 minutes of heating and further increased to 58° C. at 672 minutes of heating. At 1,200 minutes of total heating, the resulting particles were spherical with a size diameter of 5.8 micrometers and a GSD of 1.18. The reactor was then cooled down to room temperature, about 22° C. to about 25° C., and the resulting particles were washed 3 times with deionized water. The particles were then dried on a freeze dryer at a temperature of −80° C. for a period of 3 days. The toner particles obtained were comprised of 95 percent of the sulfonated polyester resin and 5 percent of the above UV fluorescent pigment.

EXAMPLE V

Preparing the Security Marks on Paper

A coupon containing a security mark was prepared in the following manner. Two xerographic engines were employed to prepare a full color coupon. The first engine, a Xerox Corporation DOCUCOLOR 12® (DC 12), having 4 development housings containing cyan, yellow, magenta and black toners (reference Example VI) were utilized to provide an image in full color, and then the image was fused to paper providing a full color print of the coupon, including the company logo. The paper containing the imaged coupon was then removed from the output tray of the first engine and fed into the second Xerox Corporation xerographic engine PC 12 comprised of two development housings which contained a glossy white toner and a UV fluorescing toner, respectfully. The resulting two white toner marks in the form of circles of about 1 centimeter in diameter were imaged by placing them on either side of the Xerox Corporation logo, which circles were then fused by heat, thereby producing a full color coupon containing two white security marks. The white visible security glossy mark was comprised of 80 percent resin and 20 percent titanium dioxide by weight of toner, and the second white security mark was invisible and was rendered visible when illuminated with UV light.

This original coupon was then placed on the above color machine and attempts to duplicate the coupon xerographically under various contrast conditions resulted in the absence of the white glossy mark or the mark appeared as a dull gray circle, indicating a fake coupon. The reproduced coupon when placed under a UV light was free of the original UV circular mark, indicating a forgery.

EXAMPLE VI

Preparing Two Security Marks on Paper

A coupon containing security marks was prepared in the following manner. Two xerographic engines, DOCUCOLOR 12® and DOCUCOLOR 1632® (Xerox Corporation DC 1632 and DC 12) were employed to prepare a full color coupon. The first engine with two development housings contained the above generated glossy white toner and the above generated UV fluorescing toner. The white glossy image of the toner was placed on the coupon as a rectangle, which was 5 centimeters by 2 centimeters. The UV fluorescing toner was placed on the coupon as a circle, which was 1 centimeter in diameter, next to the rectangular mark. Images were fused resulting in a white glossy rectangle which was clearly visible to the eye while the UV mark was not visible. The fused image was then fed in a second xerographic engine, the Xerox Corporation DOCUCOLOR 12® (DC 12), with 4 development housings containing, respectively, a cyan toner comprising 95 percent styrene butylacrylate beta CEA polymer resin and 5 percent cyan (PB 15.3) pigment, by weight of toner; a yellow toner comprising 92 percent styrene butylacrylate beta CEA polymer resin and 8 percent yellow (PY74) pigment, by weight of toner; a magenta toner comprising 94 percent styrene butylacrylate beta CEA polymer resin and 6 percent magenta pigment, by weight of toner; and a black toner comprising 95 percent styrene butylacrylate beta CEA polymer resin and 5 percent black (REGAL 330®) pigment, by weight of toner, to provide a full color designed coupon; and a barcode was placed on top of the rectangle white glossy security mark while the text message containing the coupon conditions was partially placed over the UV mark, where partially refers to a coverage of about 45 percent. The imaged color coupon was then fused resulting in a full color coupon containing two security marks. The white glossy security mark containing the barcode was clearly visible to the human eye. The same coupon when placed under UV light rendered the second mark visible as it fluoresced.

This original coupon was then placed on a Xerox Corporation DOCUCOLOR 50® color copier/printer and attempts to duplicate the coupon xerographically under various contrast conditions resulted in the barcode being copied, but with the absence of the white glossy mark or the mark appeared as a dull gray rectangle, indicating a fake coupon. The reproduced coupon, when placed under a UV light, indicated the absence of the UV circular mark, indicating a fake.

EXAMPLE VII

Preparing Two Security Marks on Paper

A coupon containing two security marks was prepared in the following manner. Two xerographic engines, reference Example VI, were employed to prepare a full color coupon. The first engine contained two development housings which contained a glossy white toner and a UV fluorescing toner, respectively. The white glossy image of the toner was placed on paper as "VALID COUPON" text at an angle of 45 degrees where each letter was 1 centimeter by 1 centimeter. The UV fluorescing toner was placed as a circle, which was 1 centimeter in diameter, next to "VALID COUPON"; The images were fused on paper where the image of "VALID COUPON" appeared as a white glossy mark, to the eye, while the UV mark was not visible. The fused image was then fed in a second xerographic engine, a Xerox Corporation DOCUCOLOR 12® (DC 12), with 4 development housings containing, respectively, a cyan, a yellow, a magenta, and a black toner, reference Example V, to provide a full color designed coupon, including the barcode. The text message containing the redemption conditions was placed over the "VALID COUPON" lettering.

The imaged color coupon was then fused resulting in a full color coupon containing two security marks. The white glossy security mark "VALID COUPON", which had the redemption text writing over it, was clearly visible to the eye. The same coupon when placed under the UV light rendered the second mark visible as it fluoresced.

This original coupon was then placed on the above DC 12 color copier and attempts to duplicate the coupon xerographically under various contrast conditions resulted in the barcode being copied but with the absence of the white glossy "VALID COUPON" mark, indicating a fake coupon. The reproduced coupon when placed under a UV light showed the absence of the UV circular mark, indicating a fake. It is desirable to place the security marks on a white background for ease of viewing.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process comprising applying a toner security mark on a document generated by xerographic means, and which mark possesses white glossy characteristics, and wherein said toner is comprised of a waterborne polymer and a colorant, and wherein said glossy is from about 65 to about 150 gardiner gloss units.

2. A process in accordance with claim 1 wherein said toner is generated by (i) preparing a waterborne resin emulsion comprised of resin particles dispersed in water;

(ii) mixing the resulting emulsion with a white colorant dispersion comprised of particles suspended in a nonionic surfactant and water;

(iii) heating the resulting emulsion colorant mixture to a temperature of about 5° C. to about 10° C. above the resin Tg, and adding a coagulant to the above mixture (iii) to initiate flocculation of resin and colorant particles;

(iv) maintaining the temperature for an additional about 2 to about 10 hours to provide toner size particles of about 3 to about 12 microns in diameter; and optionally (v) washing the resulting toner slurry with water, and isolating the toner obtained.

3. A process in accordance with claim 1 wherein said mark is present on a coupon, or currency.

4. A process in accordance with claim 1 wherein said colorant is a white pigment present in an amount of from about 10 to about 40 percent, and said polymer is present in an amount of from about 90 to about 60 percent.

5. A process in accordance with claim 1 wherein said colorant is a white pigment present in an amount of from about 20 to about 30 percent, and said polymer is present in an amount of from about 80 to about 70 percent, and wherein the total of said two components is about 100 percent.

6. A process in accordance with claim 1 wherein said mark is visible when viewed at angles of from about 15 to about 85 degrees from the perpendicular.

7. A process in accordance with claim 5 wherein the viewing angle is from about 35 to about 65 degrees.

8. A process in accordance with claim 1 wherein the waterborne polymeric resin possesses a molecular weight, $M_w$, of about 6,000 to about 150,000.

9. A process in accordance with claim 1 further including a second security mark containing a waterborne polymer and a UV fluorescent colorant.

10. A process in accordance with claim 1 further including a second security mark prepared by (i) generating a waterborne resin emulsion comprised of resin particles of a size diameter of from about 30 to about 100 nanometers dispersed in water;

(ii) mixing the emulsion with a UV fluorescent component dispersion comprised of submicron particles suspended in a nonionic surfactant and water;

(iii) heating the emulsion colorant mixture to a temperature of about 5° C. to about 10° C. above the resin Tg;

(iv) adding a coagulant to the above mixture (iii) to initiate flocculation of resin and colorant particles, and isolating the toner product.

11. A process in accordance with claim 1 wherein the colorant is a white pigment of titanium dioxide, aluminum oxide, zirconium oxide or zinc oxide.

12. A process in accordance with claim 1 wherein the white pigment Is titanium dioxide present in an amount of about 20 to about 30 percent by weight of toner, and there is present about 80 to about 70 percent polymer resin.

13. A process in accordance with claim 1 wherein there is further added a second security mark comprised of a UV excited fluorescent pigment optionally present in an amount of about 3 to about 8 weight percent by weight of toner, and wherein the waterborne polymer resin is selected in an optional amount of about 97 to about 92 weight percent by weight of toner.

14. A process in accordance with claim 13 wherein the UV excited fluorescent pigment is present in an amount of about 4 to about 7 weight percent by weight of toner.

15. A process in accordance with claim 13 wherein the UV fluorescent pigment is initially invisible, and subsequently rendered visible when subjected to UV light.

16. A process in accordance with claim 9 wherein the UV fluorescent pigment is selected from the group consisting of 4,4'-bis(styryl)biphenyl, 2-(4-phenylstilben-4-yl)-6-butylbenzoxazole, beta-methylumbelliferone, 4,-methyl-7-dimethylaminocoumarin, 4-methyl-7-aminocoumarin, N-methyl-4-methoxy-1,8-naphthalimide, 9,10-bis(phenethynyl) anthracene, and 5,12-bis(phenethynyl) naphthacene.

17. A process comprising applying a security mark toner on a document, and which mark possesses white glossy characteristics, and wherein said mark is visible and contains a pigment embedded in a waterborne polymer resin, and a second toner mark which contains a colorant that fluoresces under UV light.

18. A process comprising providing a security mark or marks on a document generated xerographically, and which mark is comprised of a glossy toner containing a waterborne polymer resin and a pigment, and wherein said glossy is from about 65 to about 150 gardiner gloss units.

19. A process in accordance with claim 1 wherein said waterborne polymer resin is as sodio-sulfonated polyester, or a styrene acrylate carboxylic acid.

20. A process in accordance with claim 1 wherein said polymer is a sodio-sulfonated polyester.

21. A process in accordance with claim 1 wherein said waterborne polymer is a poly(1,2-propylene-sodio 5-sulfoisophthalate), poly(neopentylene-sodio 5-sulfoisophthalate), poly(diethylene-sodio 5-sulfoisophthalate), copoly-(1,2-propylene-sodio 5-sulfolsophthalate)copoly-(1,2-propylene-terephthalatephthalate), copoly-(1,2-propylene-diethylene-sodio 5-sulfolsophthalate)-copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate), and wherein the salt is sodium chloride, potassium chloride, sodium bromide, or potassium bromide; poly(butylacrylate acrylic acid), poly(butylacrylate methacrylic acid), poly(butylacrylate itaconic acid), poly(butylacrylate beta carboxy ethyl acrylate), poly(butylacrylate methylmethacrylate acrylic acid), poly(butylacrylate methylmethacrylate methacrylic acid), poly(butylacrylate methylmethacrylate itaconic acid), poly(butylacrylate methylmethacrylate beta carboxy ethyl acrylate), poly(methylmethacrylate acrylic acid), poly(methylmethacrylate methacrylic acid), poly(methylmethacrylate itaconic acid), poly(methylmethacrylate beta carboxy ethyl acrylate), poly(butylacrylate butylmethacrylate acrylic acid), poly(butylacrylate butylmethacrylate methacrylic acid), poly(butylacrylate butylmethacrylate itaconic acid), poly(butylacrylate butylmethacrylate beta carboxy ethyl acrylate), poly(styrene butylacrylate acrylic acid), poly(styrene butylacrylate methacrylic acid), poly(styrene butylacrylate itaconic acid), or poly(styrene butylacrylate beta carboxy ethyl acrylate).

22. A process in accordance with claim 1 wherein said waterborne polymer is present in an amount of from about 65 to about 85 weight percent.

23. A process in accordance with claim 1 wherein said glossy value is from about 65 to about 99 GGU as measured at an angle of 75 degrees.

24. A process in accordance with claim 1 wherein said glossy value is from about 75 to about 140 GGU as measured at an angle of 75 degrees.

25. A process in accordance with claim 1 wherein the coagulant is selected from the group comprising sodium chloride, magnesium chloride, zinc chloride, aluminum chloride, calcium chloride, zinc sulfate, magnesium sulfate, aluminum sulfate, zinc acetate amines of triethylamine, tripropylamine, 2-methyl-1,5-pentanediamine, 1,4-diaminobutane, 1,8-diaminooctane, 1,5-diaminopentane, 1,6-diaminohexane, 1,7-diaminoheptane, 1,3-diaminopropane, 1,2-diaminopropane, and 1,3-diamino-2-hydroxypropane, and which coagulant is selected in an amount of about 1 to about 10 weight percent.

26. A process in accordance with claim 25 wherein said coagulant is zinc acetate.

27. A process in accordance with claim 9 wherein said polymer is selected from the group consisting of poly(1,2-propylene-sodio 5-sulfolsophthalate), poly(neopentylene-sodio 5-sulfoisophthalate), poly(diethylene-sodio 5-sulfoisophthalate), copoly-(1,2-propylene-sodio 5-sulfoisophthalate)-copoly-(1,2-propylene-terephthalatephthalate), copoly-(1,2-propylene-diethylene-sodio 5-sulfoisophthalate)copoly-(1,2-propylene-diethylene-terephthalate-phthalate), copoly-(ethylene-neopentylene-sodio 5-sulfoisophthalate)-copoly-(ethylene-neopentylene-terephthalate-phthalate), copoly-(propoxylated bisphenol A)-copoly-(propoxylated bisphenol A-sodio 5-sulfoisophthalate), and wherein the salt is sodium chloride, potassium chloride, sodium bromide, or potassium bromide; poly(butylacrylate acrylic acid), poly (butylacrylate methacrylic acid), poly(butylacrylate itaconic acid), poly(butylacrylate beta carboxy ethyl acrylate), poly (butylacrylate methylmethacrylate acrylic acid), poly (butylacrylate methylmethacrylate methacrylic acid), poly (butylacrylate methylmethacrylate itaconic acid), poly (butylacrylate methylmethacrylate beta carboxy ethyl acrylate), poly(methylmethacrylate acrylic acid), poly (methylmethacrylate methacrylic acid), poly (methylmethacrylate itaconic acid), poly (methylmethacrylate beta carboxy ethyl acrylate), poly (butylacrylate butylmethacrylate acrylic acid), poly (butylacrylate butylmethacrylate methacrylic acid), poly (butylacrylate butylmethacrylate itaconic acid), poly (butylacrylate butylmethacrylate beta carboxy ethyl acrylate), poly(styrene butylacrylate acrylic acid), poly (styrene butylacrylate methacrylic acid), poly(styrene butylacrylate itaconic acid), and poly(styrene butylacrylate beta carboxy ethyl acrylate).

28. A process in accordance with claim 9 wherein a barcode is contained on the surface of said security mark.

29. A process in accordance with claim 28 wherein said barcode Is situated below said UV fluorescent security mark.

30. A process in accordance with claim 1 wherein said security mark is located at various positions on the document.

31. A process in accordance with claim 1 wherein a second security mark is contained on said document, and which security mark contains a UV sensitive pigment.

32. A process for avoiding the reproduction of a document by providing a security mark on said document, and which mark is comprised of a glossy toner containing a pigment, and optionally a second mark containing a UV sensitive pigment.

33. A process In accordance with claim 32 wherein the document is a ticket, a coupon, an identification badge, or a negotiable security.

34. A process in accordance with claim 1 wherein the mark is viewed at an angle of from about 15 to about 85 degrees of the light source.

35. A process comprising depositing a security mark on a document, and which mark possesses white toner glossy characteristics, and wherein said toner is comprised of a waterborne polymer and a colorant, and a second security mark.

36. A process in accordance with claim 2 wherein subsequent to (iii) said coagulant is added over a time period of about 0.5 to about 3 hours to initiate flocculation of resin and colorant particles, and maintaining the temperature for an additional about 2 to about 10 hours to provide toner size particles.

37. A process in accordance with claim 10 wherein subsequent to (vii) the temperature of from about 5° C. to about 10° C. above the resin Tg is maintained for about 2 to about 10 hours to provide toner particles of about 3 to about 7 microns in volume average diameter, and isolating the toner product.

38. A process in accordance with claim 1 wherein said waterborne polymer is poly(1,2-propylene-sodio 5-sulfoisophthalate), or poly(methylmethacrylate acrylic acid).

39. A process in accordance with claim 1 wherein said waterborne is a polymer compatible with water.

40. A process in accordance with claim 1 wherein said glossy value Is from about 80 to about 130 GGU.

* * * * *